US010723670B2

(12) United States Patent
McPhail et al.

(10) Patent No.: US 10,723,670 B2
(45) Date of Patent: Jul. 28, 2020

(54) BLASTING COMPOSITIONS

(71) Applicant: Dyno Nobel Asia Pacific Pty Limited, Southbank, Victoria (AU)

(72) Inventors: Emma McPhail, Mt Thorley (AU); Brendan Griggs, Mt Thorley (AU); Jeff Gore, Mt Thorley (AU); Nathan Paris, Mt Thorley (AU)

(73) Assignee: Dyno Nobel Asia Pacific Pty Limited, Southbank, Victoria (AU)

( * ) Notice: Subject to any disclaimer, the term of this patent is extended or adjusted under 35 U.S.C. 154(b) by 0 days.

(21) Appl. No.: 14/358,347

(22) PCT Filed: Nov. 19, 2012

(86) PCT No.: PCT/AU2012/001420
§ 371 (c)(1),
(2) Date: May 15, 2014

(87) PCT Pub. No.: WO2013/071363
PCT Pub. Date: May 23, 2013

(65) Prior Publication Data

US 2014/0311634 A1 Oct. 23, 2014

(30) Foreign Application Priority Data

Nov. 17, 2011 (AU) ..... 2011904890

(51) Int. Cl.
*C06B 23/00* (2006.01)
*C06B 31/28* (2006.01)
*C06B 47/00* (2006.01)
*C06B 47/14* (2006.01)

(52) U.S. Cl.
CPC ..... *C06B 23/009* (2013.01); *C06B 23/00* (2013.01); *C06B 31/285* (2013.01); *C06B 47/00* (2013.01); *C06B 47/145* (2013.01)

(58) Field of Classification Search
CPC ..... C06B 23/09; C06B 47/00; C06B 23/00
See application file for complete search history.

(56) References Cited

U.S. PATENT DOCUMENTS 2,699,428 A 1/1955 Lux et al.
3,014,783 A * 12/1961 Young ..... B01J 2/30 423/274
3,014,788 A * 12/1961 Schaschl ..... G01N 17/00 356/226
3,160,536 A 12/1964 Aitchison
3,210,160 A 10/1965 Gordon
3,247,033 A 4/1966 Gordon
3,287,189 A 11/1966 Wilson et al.
3,294,601 A 12/1966 Gordon
3,347,722 A 10/1967 Gordon
3,770,522 A 11/1973 Tomic
3,854,400 A 12/1974 Van Langenhoven
3,930,911 A * 1/1976 Clark ..... C06B 47/14 149/46
4,104,092 A 8/1978 Mullay
4,181,546 A 1/1980 Clay
4,439,254 A 3/1984 Mullay
4,543,136 A 9/1985 Edamura et al.
4,555,278 A 11/1985 Cescon et al.
4,736,683 A 4/1988 Bachman et al.
4,775,431 A * 10/1988 Mullay ..... C06B 47/00 149/109.6
4,872,929 A 10/1989 Mullay
4,919,178 A 4/1990 Riga et al.
4,933,029 A 6/1990 Sheeran
4,957,569 A 9/1990 Waldock et al.
4,995,925 A 2/1991 Engsbraten
5,076,867 A 12/1991 McKenzie
5,123,981 A 6/1992 Mullay et al.
5,271,779 A 12/1993 Engsbraten
5,397,405 A 3/1995 Smith et al.
5,458,707 A 10/1995 Delagey et al.
(Continued)

FOREIGN PATENT DOCUMENTS

AU 2967489 1/1989
AU 2003244555 4/2004
(Continued)

OTHER PUBLICATIONS

International Preliminary Report on Patentability dated Feb. 5, 2014, issue in Application No. PCT/AU2012/001420.
Search Report dated Jul. 3, 2015, in European Patent Application No. 13757419.0.
Written Opinion of the International Searching Authority dated May 10, 2013, in Application No. PCT/AU2013/000219.
International Search Report dated May 10, 2013, in Application No. PCT/AU2013/000219.
Jemul'sionnye vzryvchatye veshhestva, perevod monografii prof. Vang Ksjuguanga, izdanija Metallurgical Industry Press, Beijing, 1994, Moskva-Krasnoarmejsk, 2002, p. 114-115 (translation for relevant sections attached).
(Continued)

*Primary Examiner* — Aileen B Felton
(74) *Attorney, Agent, or Firm* — Stoel Rives LLP

(57) ABSTRACT

A blasting explosive composition containing a solid inorganic oxidising salt as the oxidizer component, a hydrocarbon liquid as the fuel component, and a binding agent. The composition can also contain an ammonium nitrate based emulsion. The binding agent can increase the water resistance, or increase the sleep time, of the explosive composition, or increase the fuel oil absorbency of the solid inorganic oxidising salt. The binding agent is selected from one or more of a long chain carboxylic acid and its salts and derivatives, especially those having from 8 to 100 or preferably 10 to 50 carbon units. The binding agent may preferably be selected from one or more of: dimer acid, trimer acid, polyisobutylene succinic anhydride, oleic acid, stearic acid, sorbitan tristearate, and their salts and esters.

17 Claims, No Drawings

(56) References Cited

U.S. PATENT DOCUMENTS

| | | | | |
|---|---|---|---|---|
| 5,505,800 | A | 4/1996 | Harries et al. | |
| 5,567,911 | A | 10/1996 | Ekman | |
| 5,670,739 | A * | 9/1997 | Patterson | C06B 47/00 149/109.6 |
| 6,113,714 | A * | 9/2000 | Richard | C06B 31/285 149/109.6 |
| 6,955,731 | B2 | 10/2005 | Waldock | |
| 6,965,607 | B1 | 11/2005 | Landberg et al. | |
| 7,938,920 | B2 | 5/2011 | Waldock | |
| 8,568,543 | B2 | 10/2013 | Waldock | |
| 2003/0029346 | A1 | 2/2003 | Atkinson et al. | |
| 2004/0020574 | A1 * | 2/2004 | Pollack | C06B 47/145 149/46 |
| 2004/0144456 | A1 | 7/2004 | Waldock | |
| 2011/0209804 | A1 | 9/2011 | Waldock | |

FOREIGN PATENT DOCUMENTS

| | | |
|---|---|---|
| CN | 87105381 | 4/2013 |
| DE | 1571215 | 11/1970 |
| EP | 0152184 | 1/1985 |
| EP | 0152184 | 8/1985 |
| EP | 0256669 A2 | 2/1988 |
| EP | 0662464 | 12/1994 |
| EP | 1207145 | 7/1999 |
| GB | 1143264 | 2/1969 |
| GB | 1143267 | 2/1969 |
| GB | 2136792 | 9/1984 |
| JP | 11322481 | 11/1999 |
| JP | 2005255504 | 9/2005 |
| KR | 1020050108269 | 11/2005 |
| NZ | 206131 | 1/1987 |
| RU | 2103247 | 1/1998 |
| RU | 2157358 | 10/2000 |
| RU | 2230724 | 2/2003 |
| RU | 2230724 | 6/2004 |
| RU | 2301789 | 2/2006 |
| RU | 2301789 | 6/2007 |
| WO | 1992/013815 | 8/1992 |
| WO | 1994/000406 | 1/1994 |
| WO | 1997/024298 | 7/1997 |
| WO | 2000/078695 | 12/2000 |
| WO | 2002/024608 | 3/2002 |
| WO | 2002/034696 | 5/2002 |
| WO | 2002/090296 | 11/2002 |
| WO | 2003/055830 | 7/2003 |
| WO | 2004/067478 | 8/2004 |
| WO | 2013071363 | 2/2013 |
| WO | 2013131139 | 9/2013 |

OTHER PUBLICATIONS

Yagupov A. A., Ispolzovanie energii vzryva pri razrabotke mnogoletnemerzlykh rossypei (Using the energy of the explosion in the development of permafrost placers), Moscow, Nedra, 1991 p. 60-63 (Reference is in Russian, no English translation is available.).

Xuguang, Wang, "Emulsion Explosives", Beijing: Metallurgical Industry Press, 1994 (Bibliographic information only).

Yagupov, et al.,Using the Energy of the Explosion in the Development of Permafrost Placers, Moscow, Nedra ,1991 ,60-64.

Rock, et al.,Coming of Age for Low-Density Explosives, Faculty of Engineering, Coal Operators Conference 1998+, University of Wallongong, Brisbane QLD Apr. 26-28, 2005 ,175-179.

* cited by examiner

BLASTING COMPOSITIONS

CROSS-REFERENCE TO RELATED APPLICATIONS

This application is a U.S. National Phase of International Application No. PCT/AU2012/001420, filed Nov. 19, 2012, which claims priority to Australian Application No. 2011904890, filed Nov. 17, 2011. Both applications are herein incorporated by reference in their entireties.

TECHNICAL FIELD

The invention concerns blasting compositions, and methods of making and using these explosive compositions. More particularly, the explosives of the invention are a multi-component explosive formulations with a modified fuel phase. These have versatile uses in blasting performance in, but not limited to, mining operations and the like. Particularly, though not exclusively, the present invention relates to the manufacture and use of various forms of Ammonium Nitrate Fuel Oil (ANFO) based explosives which have been modified by the incorporation of a binding agent in the fuel oil.

BACKGROUND ART

ANFO mixtures are commonly used as explosives in mining and in other applications. These mixtures provide effective blasting results, particularly when low bulk density explosive grade ammonium nitrate (EGAN) prill is used. Such EGAN is manufactured to have a porous outer surface, which adsorbs sufficient fuel oil to provide a slightly negative oxygen balanced explosive; and a porous inner volume, that lowers the density and provides voids that act as "hot spots" during the detonation process.

High bulk density agricultural grade ammonium nitrate (AGAN) is also useable in ANFO. AGAN is manufactured without introducing external and internal porosity, and hence there are some technical problems that need to be overcome so as to enable its use in ANFO.

Other sources of ammonium nitrate are also known, which have been manufactured by a process similar to AGAN where the level of porosity is minimal, but which have a bulk density similar to EGAN because of the inclusion of a large dimple or hole.

The main technical disadvantages of ANFO are that (i) the product is damaged by the presence of relatively small amounts of water; (ii) the explosive energy of the mixture per unit volume (the bulk strength) is fixed for a given ammonium nitrate prill, dependant only on its bulk density; and (iii) the velocity of detonation (VOD) is limited to relatively moderate values. These disadvantages may be overcome by mixing ANFO with an ammonium nitrate based emulsion (ANE) in various proportions.

An ANE is a water-in-oil emulsion, where the dispersed water phase is comprised of ammonium nitrate, water, and other minor components, and the continuous oil phase is comprised of emulsifiers and carbonaceous liquids or solids. As ANEs are more expensive than ANFO, the blend ratio used in an explosive composition is generally the minimum needed to provide the required water resistance, bulk strength, VOD, or combination thereof.

Mixtures of ANE and ANFO that are comprised of 1% to 50% ANE and 99% to 50% ANFO are known as heavy ANFO (HANFO) mixtures. HANFO mixtures are used to provide a higher bulk strength product for use in ground which requires a higher level of energy to be effectively blasted; and at the higher levels (above 40% ANE) some water resistance. Mixtures with 50% to 100% ANE and 0% to 50% ANFO generally need to be sensitized by addition of chemical gassing agents or solid sensitization in order to detonate efficiently and are commonly referred to as "slurry" emulsion/ANFO blends. Such ANE and ANFO mixtures that are sensitized using chemical gassing agents are known as gassed blends. Emulsion/ANFO blends, including gassed blends, provide explosive compositions with a significant level of water resistance, and also allow a higher VOD to be obtained. These blends are used for charging into wet blastholes, sleeping the product in wet conditions, and for use in ground which is composed of rock with a higher compressive strength, and requires an explosive with a higher VOD (ie, more brissant) to blast it; or where a greater level of fragmentation of the ground is required.

It is generally preferred to use EGAN in HANFO and in gassed blends. However difficulties with the availability of the product, its cost, and its quality often mean that the use of the other ammonium nitrate types in explosive compositions will be attempted. There are some significant technical difficulties with this, arising from the lack of internal porosity of the prill to provide sensitization of the mixture; and the lack of external porosity to absorb the required level of fuel oil to provide the required slightly negative oxygen balance. In particular, if non-EGAN is used to manufacture ANFO, the fuel oil is not absorbed into the surface of the prill and wicking may occur resulting in diesel oil seeping away and into the ground, leaving behind the ammonium nitrate prill. The displacement of diesel will also change the explosive properties, resulting in an explosive with a positive oxygen balance and increased risk of post-blast fumes occurring. If such ANFO is mixed with emulsion to form a HANFO or gassed blend, the unabsorbed diesel will mix with and then dilute the emulsion. The viscosity of the emulsion will decrease and the product may not maintain its column integrity in the hole. The decreased viscosity emulsion can seep into cracks and fissures in the hole, causing slumping of the product.

The standard methods of overcoming these shortcomings are to: (i) use a mineral oil as the fuel component, which has a significantly higher viscosity than diesel fuel oil, which is retained by the AGAN at a higher level, and which leads to a smaller loss of viscosity in the emulsion phase should they be mixed; and (ii) for emulsion blends, replacing the diesel used on the ANFO by incorporating a higher level of fuel phase into the ANE. Using the later described method means that the viscosity of the emulsion is not compromised, and the increased fuel phase present accommodates for the non-incorporation of diesel in the ammonium nitrate component. But both of these methods are relatively expensive, in terms of the raw materials used or the change in production parameters required.

One way to address these issues is to ensure that the fuel oil is retained by the prill. By increasing the fuel oil absorption and adsorption capacity of the non-EGAN prill, wicking and dilution are avoided. It has been known to use additives with the fuel oil that aid in coupling the fuel oil to the surface of the AGAN prill. An example is described in Canadian Patent Application 2438161A1 which consists of epoxidized oils, vegetable oils, and ester derivatives of such being added to the fuel oil. Another example involves using solid fuel sources such as carbon black, as described in U.S. Pat. No. 3,540,953. However, using such materials requires the modification of existing explosive delivery machinery and it use can result in a build up of material that can clog key equipment. To avoid problems arising from such a build up, it would therefore be advantageous to have a binding agent that would dissolve in a fuel oil and would require no further modification to current explosive delivery equipment. It can also be chemically different than the known coupling agents described above to provide an alternative, and it would also be useful if it could have improved functionality, particularly in heavy ANFO type products and emulsion/ANFO blends. Another potential advantage is to utilise new components that have a new supply source, and which can be economically substituted for some of the oil previously used in these blasting formulations.

Accordingly, it would be useful to provide a new solution that avoids or ameliorates the disadvantages present in known approaches, or which provides an alternative to these approaches.

DISCLOSURE OF THE INVENTION

One aspect of the invention provides a blended explosive composition having an oxidizer component and a fuel component, wherein the oxidizer component may preferably contain ammonium nitrate, and the fuel component contains carbonaceous materials such as fuel oil as well as a binding agent. The binding agent is selected from one or more of a long chain carboxylic acid and its salts and the derivatives thereof.

Another aspect of the invention concerns a method of increasing the water resistance, and/or increasing the sleep time, of a blended explosive composition having an oxidizer component and a fuel component, wherein the oxidizer component contains one or more oxidizer salts, and the fuel component contains carbonaceous material and a binding agent, which comprises the step of adding a binding agent that is selected from one or more of a long chain carboxylic acid and its salts and the derivatives thereof to a blended explosive composition.

Preferably, the oxidiser salt may be in the form of separate discrete particles, such as prill.

In one preferred form, the explosive composition is an ammonium nitrate/fuel oil (ANFO) type of explosive composition. In another preferred form, the explosive composition is an ammonium nitrate/fuel oil (ANFO) type of explosive composition mixed with an ammonium nitrate based emulsion type of explosive composition.

Preferably, the long chain carboxylic acid may be a C8 to C100 long chain carboxylic acid. Also long chain carboxylic acid may preferably be stearic acid or oleic acid or the di- or tri-oligomers thereof. The derivatives of the long chain carboxylic acids may preferably be selected from any one or more of the esters, lactones, amides, lactams, anhydrides, acid chlorides or other halides, or imides of these acids. The binding agent may be selected for example, from one or more of: dimer acid, trimer acid, polyisobutylene succinic anhydride, oleic acid, stearic acid, sorbitan tristearate, and their salts and esters.

Preferably, the binding agent may comprises from 5% to 50% by weight of the fuel component, or more preferably from 10% to 20% by weight of the fuel component. It is also preferred that the fuel component contains a substantial portion of diesel oil, and the remainder being mineral oil. The oxidizer component may contain a substantial portion of high density ammonium nitrate prill and/or low density non-porous prill, and the remainder being low density porous ammonium nitrate prill and/or water.

MODES FOR CARRYING OUT THE INVENTION

In one broad form, the invention concerns a blasting explosive composition containing a solid inorganic oxidising salt as the oxidizer component, a hydrocarbon liquid as the fuel component, and a binding agent. The composition can also contain an ammonium nitrate based emulsion.

The binding agent is selected from one or more of a long chain carboxylic acid and the derivatives thereof and the salts of such acids or derivatives. The derivatives may be the esters, lactones, amides, lactams, anhydrides, acid chlorides or other halides, or imides, for instance. The salts may be salts with common alkali metal or alkali earth metal cations, or with ammonium or amine cations, especially long chain amine cations, for example.

The binding agent is preferably selected so as to increase the water resistance of the explosive composition. The binding agent may preferably also or alternatively be selected to increase the fuel oil absorbency of the solid inorganic oxidising salt. Furthermore, the binding agent may preferably be selected to increase the sleep time of the explosive composition.

The binding agent is selected from one or more of a long chain carboxylic acid and its salts and derivatives. The carbon chain may preferably have from about 8 to 100 carbon units, and more preferably from about 10 to 50 carbon units. The chain may be saturated or unsaturated, and unbranched or branched. The long chain compound may have one carboxylic acid functional group or multiple such groups; such as two or three groups.

The long carbon chain may have from about 8 to 100 carbon units, preferably from 10 to 50. In one preferred form, the long carbon chain is selected from stearic acid or oleic acid, or di- and tri-component derivatives of such acids.

Preferably it may be selected from one or more of: dimer acid, trimer acid, polyisobutylene succinic anhydride, oleic acid, stearic acid, and their salts and esters. In one particularly preferred form it may be a dibasic acid such as dimer acid or polybutylene succinic anhydride (PIBSA), or their derivatives or may be a mixture thereof. Dimer acid is a C36 Dimer acid, which is predominantly a dimer of (C18) stearic acid. Other suitable acids are described below.

The solid inorganic oxidising salt is generally ammonium nitrate particles and can be in the form of porous prill, high density prill, non-porous prill, crystalline ammonium nitrate, fines or a combination thereof. The porous prill can have a particle size between 6 and 20 TYLER sieve size and a particle density of about 1.35 g/cc to about 1.52 g/cc, a prill void volume of 10.0 to 18.5% and a bulk density of about 0.7 to about 0.85 g/cc. The high density prill can have a bulk density of about 0.85 g/cc to 1.00 g/cc Ammonium nitrate particle fines normally have a particle size smaller than 20 TYLER sieve size.

The ammonium nitrate based emulsion (ANE) is of a water-in-oil type, which has as its discontinuous phase an oxygen-releasing salt solution and has as its continuous phase an organic water-immiscible fuel component. The oxygen-releasing salt solution can be selected from the group consisting of ammonium nitrate, sodium nitrate, calcium nitrate, urea and water and mixtures thereof. The ammonium nitrate can comprise from 50% to about 94% by weight, and preferably from 60 to 85%, by weight, of the total composition of the ammonium nitrate based emulsion. The urea can comprise from 0 to 20% weight and preferably from 0 to 9%, by weight, of the total composition of the ammonium nitrate based emulsion. The organic water-immiscible fuel component can comprise from 1 to 10%, by weight, of the total composition of the ammonium nitrate based emulsion. The organic water-immiscible fuel component can comprise an emulsifier agent. The emulsifier agent can comprise at least one derivative of poly(isobutylene) succinic anhydride and an amine or alkanolamine emulsifier. The emulsifier agent can comprise from 0.3 to 3.5%, by weight, of the total composition of the ammonium nitrate based emulsion A process for producing an ammonium nitrate based emulsion composition can comprise dissolving an oxygen-releasing salt solution at a temperature above the fudge point of the oxygen-releasing salt solution. The acidity of the oxygen-releasing salt solution is adjusted between about pH 2.0 to about pH 7.0. The oxygen-releasing salt solution and organic water-immiscible fuel component are combined and mixed until the ammonium nitrate based emulsion is uniform.

The oxygen-releasing salt solution can include a gassing catalyst. The gassing catalyst can be selected from a group of thiocyanate or thiourea compounds. The gassing catalyst can comprise from about 0.1% to 1%, preferably 0.1% to 0.6%, by weight, of the total composition of the oxygen-releasing salt solution.

The hydrocarbon liquid can be selected from the group consisting of #2 diesel, a petroleum hydrocarbon, aromatic hydrocarbon, glycol, fuel oil, heating oil, jet fuel, kerosene, mineral oils, fatty acids, alcohols, vegetable oil and mixtures thereof.

The explosive composition may be in the form of an ammonium nitrate/fuel oil (ANFO) type of explosive composition, or an ammonium nitrate/fuel oil (ANFO) type of explosive composition mixed with an ammonium nitrate based emulsion (ANE) type of explosive composition, or as an ammonium nitrate based emulsion (ANE) type of explosive composition. With the blasting explosive compositions involving an emulsion (ie ANE), then the binding agent should be selected among those long chain carboxylic acid or its salts or derivatives that do not destabilise the emulsion. This can be determined by simple trial, to observe the effect of the binding agent utilised in the invention upon the stability of the emulsion. It is advisable to select binding agents that do not cause premature crystallisation of the components in the emulsion. It has been noted that as a very general indication, that monostearates tend to make the emulsions unstable, but di- and tri-stearates are stable with the emulsion, while all three types improve the water resistance. Of course, this is not an issue with ANFO blasting compositions that do not involve the presence of emulsions.

Explosive compositions, particularly emulsion explosives, can include a density reducing agent. The density reducing agent can be selected from the group of materials consisting of fine gas bubbles, hollow particles or microballoons, low density particles or mixtures thereof. The density of the explosive composition is preferably in the range of 0.30 to 1.50 g/cc.

In one preferred form, the explosive composition may be an explosive mixture including an inorganic oxidizing salt, fuel oil (consisting of binding agent and carbonaceous material), and may also contain an explosive emulsion.

It is preferred that the binding agent is present in an amount about 5% to about 50 wt % based upon the weight of the fuel component. More preferably, the binding agent is present in an amount from about 10% to about 20 wt %.

The binding agent binds the oxidizer component and the fuel component, and is ideally selected so as to be dissolvable into the carbonaceous material. The binding agent is selected from long chain mono- or poly-carboxylic acids and/or their salts and/or derivatives, especially the ester derivatives. It may preferably be a dibasic acid, such as dimer acid. In this situation, the dibasic acid may be an oligomeric fatty acid, a fatty acid or derivative, or a mixture thereof. Preferably, the fatty acid is an oligomer of octadecenoic acid, such as dimer acid or trimer acid. Another preferred such binding agent is sorbitan tristearate.

Most preferably, the dibasic fatty acid is dimer acid (CAS: 61788-89-4). As another example, the dibasic acid may be polyisobutylene succinic anhydride (PIBSA) or a derivative, or a mixture, thereof. Oleic or trimer acid are other preferred binding agents. Dimer acid is commonly a mixture of dimer acid (75-82%), trimer acid (16-22%) and monomer acid (1-3%).

Other possible agents include stearic acid salts and/or derivatives. An example of these is sorbitan tristearate, (CAS: 26658-19-5) which is a mixture of the partial esters of sorbitol and its anhydrides with stearic acid. Other such agents may especially be various di- and tri-stearates and their salts and derivatives.

Another possible binding agent is "Dodiflow", which is manufactured by the Clarient AG company of Switzerland. The product sold as "Dodiflow" is a reaction product of an alkenylspirobislactone with one mole of di(hydrogenated tallow) amine and one mole of (hydrogenated tallow) amine, also known as N-stearyl maleimide octadecyl copolymer.

The counter ions to such stearic or other acid salts may include diethylethanolamine, triethanolamine, ethanolamine, diethylethanolamine, as well as alkali metal or alkali earth metal salts, or other metal salts, or ammonium or long chain hydrocarbon tetra-ammonium salts, as some examples. Salts such as sodium, ammonium, calcium, aluminium or the like salts may be used. Other agents include stearic acid esters, eg, glycerol monostearate and tetraglycerol tristearate.

The binding agents may be a derivative of the acids, as well as their salts, particularly their esters, lactones, amides, lactams, anhydrides, acid chlorides or other halides, or imides or sulfonic acid and its derviatives. If the acid is used, it may be advantageous to adjust the pH of the mixture, because too low a pH can result in destabilisation of the ammonium nitrate, so adjusting the pH may be necessary in such instances, such as by adding sodium hydroxide, or a similar base to the acid for instance.

The carbonaceous material according to the invention, is normally a fuel oil or alternate component that may be used in ANFO, emulsion, or HANFO blasting explosives. It is usually a long chain hydrocarbon oil, or derivatives thereof.

The carbonaceous material may be selected from any fuel known in the art (e.g. fuel oil, heating oil, diesel fuel, jet fuel, kerosene, mineral oils, saturated fatty acids such as lauric acid and stearic acid, alcohols, vegetable oil and the like). Preferably, the organic carbonaceous material comprises fuel oil, such as No. 2 diesel oil.

The inorganic oxidizing salts are preferably selected from the group consisting of ammonium, alkaline-earth nitrates and alkali metal nitrates. Preferably, the oxidizer salts are ammonium nitrate (AN) in combination with calcium nitrate (CN) or sodium nitrate (SN) and mixtures thereof. Most preferably, the oxidizer salt is ammonium nitrate. The oxidiser salt(s) is in the form of separate discrete particles, such as prills, granules, pellets, and/or fines as opposed to cast or powdered or solutions. The amount of oxidizer salt(s) employed is generally from 9% to about 94%, by weight of the total composition.

It is preferred that the fuel oil is present in an amount about 2 to about 10 wt % based upon the weight of the inorganic oxidizing salt and the fuel. More preferably, the fuel oil is present in an amount from about 4 to about 8 wt % and, most preferably, the ratio of inorganic oxidizing salt to fuel oil is about 94:6. The explosive composition when loaded into a borehole can be ANFO, HANFO or a sensitized emulsion:ANFO slurry.

The blasting compositions made according to the invention that include long chain carboxylic acids and their salts and derivatives as a binding agent have been found to have good water resistance. The invention therefore concerns a method of improving the water resistance of such compositions, by including these binding agents in the explosive mixture.

EXAMPLES

Example 01

Dimer Acid

Dimer acid (36 carbon units) was tested as a binding agent, in an emulsion blasting composition. The emulsion stability held up well, and there was generally improved water resistance when compared to standard emulsions without the addition of a binding agent. Around 10% to 30% of the fuel component was replaced with the dimer acid. It readily dissolved in the diesel oil. The explosives blend permitted 28 to 94% AN and 1.8 to 6% Fuel Oil. Both HDAN and LDAN prill could be used.

Example 02

Oleayl Dimer Monostearate

Oleayl dimer monostearate (C54) was tested. There was good emulsion stability, and good water resistance. The binding agent replaced 10% to 30% of the fuel component, and it readily dissolved in the diesel, and 56-94% AN and 1.8-6% FO was blended, using both HDAN and LDAN prill.

Example 03

Oleayl Dimer Distearate

Oleayl dimer distearate (C72) was tested. There was good emulsion stability, and good water resistance. The binding agent replaced 10% to 30% of the fuel component, and it readily dissolved in the diesel, and 56-94% AN and 1.8-6% FO was blended, using both HDAN and LDAN prill.

Example 04

Dimer Acid/Genamin OL 500D

A mixture of Dimer Acid and Genamin™ OL 500D was tested. Genamin OL 500D is a distilled oleyl ammonium acetate salt compound. There was average emulsion stability but with some slight crystallisation. The binding agent replaced 20% to 50% of the fuel component, and it readily dissolved in the diesel, and 56-94% AN and 1.8-6% FO was blended, using both HDAN and LDAN prill.

Example 05

Dodiflow

Dodiflow™ was tested, being an N-stearyl maleimide octadecyl copolymer compound. There was good emulsion stability with good water resistance. The binding agent replaced 10% to 20% of the fuel component, and it dissolved in the diesel after some heating, and 56-94% AN and 1.8-6% FO was blended, using both HDAN and LDAN prill prill.

Example 06

PEG 600 Distearate

PEG 600 distearate was tested, being a di-ester of stearic acid with polyethylene glycol. There was some crystallisation in the emulsion. The binding agent replaced 10% to 20% of the fuel component, and it dissolved in the diesel after some heating, and 56-94% AN and 1.8-6% FO was blended, using both HDAN and LDAN prill.

Example 07

Sorbitan Stearate

Sorbitan stearate (C24) was tested. There was very good water resistance. The binding agent replaced 10% to 20% of the fuel component, and it dissolved in the diesel after heating, and 47-94% AN and 1.8-6% FO was blended, using LDAN prill.

Example 08

Sorbitan Tristearate

Sorbitan tristearate (C60) was tested. There was good emulsion stability observed and very good water resistance. The binding agent replaced 10% to 20% of the fuel component, and it dissolved in the diesel after heating, and 47-94% AN and 1.8-6% FO was blended, using LDAN prill.

Example 09

Diethylenetriamine Tristearate

Diethylenetriamine tristearate (C58) was tested. There was some crystallisation in the emulsion, and fair water resistance. The binding agent replaced 5% to 15% of the fuel component, and it dissolved in the diesel after heating, and 56-94% AN and 1.8-6% FO was blended, using HDAN prill.

Example 10

Methylamine Stearate

Methylamine stearate (C19) was tested. There was some crystallisation in the emulsion, and fair water resistance. The binding agent replaced 5% to 15% of the fuel component, and it dissolved in the diesel after heating, and 56-94% AN and 1.8-6% FO was blended, using HDAN prill.

Examples 11 to 40 were carried out in a similar manner to Examples 1 to 10.

| Example | Binder |
|---|---|
| 11 | 3-methoxypropyl amine stearate |
| 12 | ethylamine stearate |
| 13 | dimethylethanolamine stearate |
| 14 | dimethylethyl stearate |
| 15 | dimethylethanolamine stearate/dimer acid half salt |
| 16 | Triethanolamine stearate |
| 17 | Triethanolamine stearate/dimer acid half salt |
| 18 | Diethylethanolamine stearate |
| 19 | Tetraglycerine tristearate |
| 20 | glycerol tristearate |
| 21 | Tetraglycerine stearate |
| 22 | Ethanolamine stearate |
| 23 | diethanol amine stearate |
| 24 | Genamin ™ SPA (stearamidopropyl dimethylamine) |
| 25 | Genamin ™ SPA stearate (stearamidopropyl dimethylamine stearate) |
| 26 | dimer acid salt of Genamin ™ SPA (mono) |
| 27 | PIBSA salt of Genamin ™ SPA (mono) |
| 28 | Tallow diamine distearate |
| 29 | Tallow diamine monostearate |
| 30 | C18 tertiary amine mono stearate |
| 31 | C18 tertiary amine mono stearate/dimer acid |
| 32 | C14 tertiary amine mono stearate |
| 33 | C10 tertiary amine mono stearate |
| 34 | Octadecylamine/Dimer acid (1:1) |
| 35 | Octadecylamine/oleic acid |
| 36 | Octadecylamine ethylhexanoic acid |
| 37 | Octadecylamine methylcanolate |
| 38 | Dodecylamine/dimer acid |
| 39 | PIBSA Tetrastearate |
| 40 | distearyl oleayl tetraglycerine |

Water Resistance Testing

Various comparison examples (ie, as Comparison Examples 1 to 5) were prepared, as described below. In addition some examples of the explosives composition according to the present invention (ie, Examples A to E) were also prepared, as described below.

The relative effectiveness of the various formulations was determined according to the following testing procedures.

General Emulsion Manufacture Procedure

The ingredients of the oxidizer phase were heated to 75 C to form an aqueous solution. Separately, the ingredients of the fuel phase were mixed while heating to 65 C. The hot oxidizer phase was then poured into the fuel phase slowly, with agitation provided by a Lightnin' Labmaster™ mixer fitted with a 65 mm Jiffy™ stirring blade rotating initially at 600 rpm for 30 seconds. The crude emulsion was refined by stirring at 1000 rpm for 30 seconds, 1500 rpm for 30 seconds and 1700 rpm until the stated viscosity was achieved. The quantity of product prepared in each sample was 2.00 kg.

First General Water Resistance Procedure

A 100 g homogenous blend containing 50 g of emulsion and 50 g of ANFO was prepared in a 250 ml glass beaker, and this blend was maintained at a known room temperature. A 100 g sample of water, at the same known room temperature, was added to the emulsion:ANFO blend and the temperature of the blend was immediately recorded as temperature initial ($T_0$). A 5 minute timer was started and the contents of the beaker were immediately hand mixed using a 10 mm glass rod by rotating for 20 revolutions at a rate of approximately 1 second/revolution. On completion of the mixing the contents of the beaker were left to stand until the end of the 5 minute interval, at which time, the temperature of the watery component was recorded ($T_5$). A visual observation of the contents of the beaker post mixing was additionally recorded. The difference between T0 and T5 indicates the proportion of endothermic ammonium nitrate dissolution resulting from the degree of water resistance imparted on the ammonium nitrate by the emulsion component.

General Rod Rating Procedure

Emulsion and ANFO blends are prepared as either heavy ANFO blends or gassed emulsion blends. A 10 mm glass rod is dipped into the blend at a 45 degree angle to a depth of approximately 20 mm to coat one side of the glass rod with blend, the glass rod is then lightly tapped to remove excess prill and/or emulsion. The glass rod is held toward a light source with side coated with emulsion facing away such that the light can visually pass through the glass rod. The emulsion is than lightly rubbed along the glass rod three times and the proportion of crystals are measured as follows:

8=no crystals,

7=small amount of crystals,

6=half emulsion:half crystals,

5=mostly crystals with some emulsion,

4=All crystals with no emulsion.

The blend is continually rated for the proportion of crystal formation over time at known intervals.

General Fuel Absorbance Procedure

The initial mass of ammonium nitrate (50 g) is weighed into a 250 ml beaker. 100 ml of diesel is added to the ammonium nitrate prill. This is left for 15 minutes to allow the diesel to fully absorb. Excess diesel is then poured off and all the ammonium nitrate is poured onto absorbent paper. A piece of absorbent paper towel is placed over the top of ammonium nitrate and pressed to remove excess diesel. The ammonium nitrate is transferred to another piece of absorbent paper towel and an additional piece of absorbent paper towel is used to remove excess diesel. The final mass of the ammonium nitrate is weighed and the fuel oil absorbency is determined by deducing the final mass from the initial mass and dividing that value by the initial mass.

Second General Water Resistance Procedure

An alternative water resistance procedure can show the effect of different additives on the water resistance ability of the blends.

A 55 ml container was filled to the top with a homogenous blend containing 50% of emulsion and 50% of ANFO by weight. The container was placed into a 600 ml beaker. Then 250 ml of water was added to the beaker. A jiffy mixer blade was positioned approximately 14 mm above the sample. The jiffy mixer blade was turned on at 1000 rpm for approximately 30 minutes. The conductivity was measured periodically.

Comparison Example 1

Comparison Example 1 represents a standard formulation to be used as a comparison example. The formulation is shown in Table 1. The emulsifier was selected from the group of emulsifiers that result from condensation reactions between PIBSA (polybutenyl succinic anhydride) and amines or alkanolamines. The mineral oil used was predominantly paraffinic with some aromatic and naphthenic constituent compounds. The emulsion was formed with a viscosity about 25,000 cP. A gassed blend of 60 parts emulsion and 40 parts ANFO by weight was prepared and chemically gassed to the desired density of 1.05 g/cc, which is a typical density for mixtures of this type. The ammonium nitrate prill type used for the ANFO has a bulk density of 0.82 g/cc and a fuel oil absorption of 6% and is imported from the Louisiana Mo. Ammonium Nitrate plant owned by Dyno Nobel (herein referred to as LOMO prill). As Table 2 shows, the water resistance of the blend is good.

TABLE 1

| Standard Emulsion Formulation | |
|---|---|
| Oxidiser Component | 94% |
| Ammonium Nitrate | 75% |
| Water | 25% |
| Fuel Component | 6% |
| Emulsifier | 15% |
| Mineral Oil/ Fuel Oil | 85% |

TABLE 2

| Water Resistance Results of Gassed Emulsion Blend using LOMO AN Prill ANFO | |
|---|---|
| Temperature Initial ($T_0$) | 14 C. |
| Temperature Final ($T_5$) | 11 C. |
| Temperature Difference | 3 C. |

Comparison Example 2

In Comparison Example 2, the process conditions were kept as close as possible to those described in Comparison Example 1. Thus Comparison Example 1 was repeated except that the ammonium nitrate prill type for the ANFO was non-porous Acron ammonium nitrate prill. Although the prill was non-porous the bulk density was 0.74 g/cc, which arises due to the dimple in the centre of the prill. When fuel oil is mixed with the prill it is typically retained in the dimple, and not adsorbed onto the surface or otherwise absorbed. Upon contact with emulsion the fuel oil is available to mix with emulsion and cause emulsion thinning. The same emulsion component used in Comparison Example 1 was used in this example. A gassed blend of 60:40 parts emulsion:ANFO was prepared and chemically gassed to the desired density of 1.05 g/cc. As Table 3 shows, the results for the water resistance of this blend are poor, and it was observed in the water resistant test that the Acron prill separates from the emulsion.

TABLE 3

| Water Resistance Results of Gassed Emulsion Blend using Acron AN Prill ANFO | |
|---|---|
| Temperature Initial ($T_0$) | 14 C. |
| Temperature Final ($T_5$) | 6 C. |
| Temperature Difference | 8 C. |

Example A

An experiment was conducted to see how dimer acid works in different formulations. In Example A, the same emulsion was used from Comparison Example 1. The ammonium nitrate prill source was Acron AN prill. The fuel oil component for the ANFO consisted of 10% dimer acid and 90% diesel oil. A gassed blend of 60:40 parts emulsion: ANFO was prepared and chemically gassed to the desired density of 1.05 g/cc. As Table 4 shows, the water resistance has improved compared to Comparison Example 2 and is consistent with Comparison Example 1.

TABLE 4

| Water Resistance Results of Gassed Emulsion Blend using Acron AN Prill & dimer acid in diesel ANFO | |
|---|---|
| Temperature Initial ($T_0$) | 14 C. |
| Temperature Final ($T_5$) | 11 C. |
| Temperature Difference | 3 C. |

Comparison Example 3

Comparison Example 2 was repeated where the Acron ammonium nitrate prill was replaced with Chempure ammonium nitrate. Chempure has no coating agents added and is in a crystalline form. Water resistance of a 60:40 gassed blend was undertaken. As Table 5 shows, the water resistance is poor and it was observed that the chempure separated from the emulsion during the water resistance testing.

TABLE 5

| Water Resistance Results of Gassed Emulsion Blend using Chempure AN ANFO | |
|---|---|
| Temperature Initial ($T_0$) | 14 C. |
| Temperature Final ($T_5$) | 5 C. |
| Temperature Difference | 9 C. |

Example B

Comparison Example 3 was repeated with the only difference that the fuel oil component was replaced with a mixture of 10% dimer acid and 90% diesel. As Table 6 shows, the water resistance of the blend is improved.

TABLE 6

| Water Resistance Results of Gassed Emulsion Blend using Chempure AN & dimer acid in diesel ANFO | |
|---|---|
| Temperature Initial ($T_0$) | 14 C. |
| Temperature Final ($T_5$) | 8 C. |
| Temperature Difference | 6 C. |

Comparison Example 4

A blend of 60:40 parts emulsion:ANFO was prepared using KT technology ammonium nitrate prill from Queenland Nitrates Pty Ltd, herein referred to as "QNP", and chemically gassed, similarly to that used in Comparison Example 1. The emulsion blend was evaluated for the degree of emulsion crystallisation over time using the rod rating procedure. Table 7 shows the degree of crystallization does increase over time.

TABLE 7

Rod Rating Results of Gassed Emulsion Blend using KT AN prill ANFO

| Number of Days | Crystallisation Rating |
|---|---|
| 0 | 7 |
| 4 | 6 |
| 14 | 5 |
| 20 | 5 |

Comparison Example 5

A HANFO blend of 40:60 parts emulsion:ANFO was prepared using LOMO ammonium nitrate prill in the ANFO component. The degree of crystallization of the emulsion component was measured over time using the rod rating procedure. Table 8 shows that increased crystallization is evident over time.

TABLE 8

Rod Rating Results of HANFO Blend using LOMO AN Prill ANFO

| Number of Days | Crystallisation Rating |
|---|---|
| 0 | 7 |
| 4 | 7 |
| 14 | 4 |
| 20 | 4 |

Example C

A gassed emulsion blend (60:40 parts emulsion:ANFO) was prepared similarly to Comparison Example 1, whereby the ANFO was prepared using Acron ammonium nitrate prill and the fuel oil component consisted of 10% dimer acid and 90% diesel. As Table 9 shows, a reduced rate of emulsion crystallization over time, compared to the use of LOMO prill with no dimer acid present, is evident.

TABLE 9

Rod Rating Results of Gassed Emulsion Blend using Acron AN Prill & dimer acid in diesel ANFO

| Number of Days | Crystallisation Rating |
|---|---|
| 0 | 7 |
| 4 | 7 |
| 14 | 6 |
| 20 | 6 |

Example D

A HANFO blend of 40:60 parts emulsion:ANFO was prepared whereby the ANFO component consisted of Acron ammonium nitrate prill and fuel oil component containing 10% dimer acid and 90% diesel. As Table 10 shows, a reduced rate of emulsion crystallization over time, compared to the use of KT prill with no dimer acid present, is evident.

TABLE 10

Rod Rating Results of HANFO Blend using Acron AN Prill & dimer acid in diesel ANFO

| Number of Days | Crystallisation Rating |
|---|---|
| 0 | 7 |
| 4 | 7 |
| 14 | 6 |
| 20 | 6 |

Example E

Various dimer and diesel oil solutions were prepared consisting of 0%, 10%, 20% and 30% dimer acid with the remainder being diesel. The fuel oil absorbency was measured and Table 11 shows the results. The results show a trend of improved fuel oil absorbency as the amount of dimer acid is increased.

TABLE 11

Fuel Oil Absorbency of Acron AN Prill with different dimer acid content in the diesel

| % Dimer Acid | Fuel Oil Absorbency |
|---|---|
| 0 | 3.4% |
| 10 | 4.1% |
| 20 | 5.0% |
| 30 | 5.4% |

Comparison Example 6

In Comparison Example 6, the process conditions were kept as close as possible to those described in Comparison Example 1. Thus, Comparison Example 1 was repeated except that the ammonium nitrate prill type for the ANFO was low density ENAEX Prillex AN. A blend of 40:60 parts emulsion:ANFO was prepared. Table 12 shows the results for the water resistance, tested according to the Second General Water Resistance Procedure described above.

TABLE 12

Conductivity Water Resistance Results of Gassed Emulsion Blend using ENAEX Prillex AN Prill ANFO

| Time (min) | Conductivity (mS/cm) |
|---|---|
| 0 | 0 |
| 15 | 4.9 |
| 30 | 7.0 |

Example F

Comparison Example 6 was repeated with the difference that the fuel oil component was replaced with a mixture of 20% dimer acid and 80% diesel. As Table 13 shows, the conductivity is reduced when compared to the results in Table 12 indicating an improvement in the water resistance of the blend.

TABLE 13

Water Resistance Results of Gassed Emulsion Blend using ENAEX Prillex AN & dimer acid in diesel ANFO

| Time (min) | Conductivity (mS/cm) |
|---|---|
| 0 | 0 |
| 15 | 1.5 |
| 30 | 2.0 |

Example G

Comparison Example 6 was repeated with the only difference that the fuel oil component was replaced with a mixture of 10% sorbitol tristearate and 90% diesel. As Table 14 shows, the conductivity is reduced when compared to the results in Table 12 indicating an improvement in the water resistance of the blend.

TABLE 14

| Water Resistance Results of Gassed Emulsion Blend using ENAEX Prillex AN & dimer acid in diesel ANFO | |
|---|---|
| Time (min) | Conductivity (mS/cm) |
| 0 | 0 |
| 15 | 1.4 |
| 30 | 1.5 |

Example H

Comparison Example 6 was repeated with the difference that the fuel oil component was replaced with a mixture of 10% Dodiflow and 90% diesel. As Table 15 shows, the conductivity is reduced when compared to the results in Table 12 indicating an improvement in the water resistance of the blend.

TABLE 15

| Water Resistance Results of Gassed Emulsion Blend using ENAEX Prillex AN & Dodiflow in diesel ANFO | |
|---|---|
| Time (min) | Conductivity (mS/cm) |
| 0 | 0 |
| 15 | 1.1 |
| 25 | 1.2 |

Comparison Example 7

In Comparison Example 7, the process conditions were kept as close as possible to those described in Comparison Example 1. Thus Comparison Example 1 was repeated except that the ammonium nitrate prill type for the ANFO was low density Tianji A N. A blend of 30:70 parts emulsion: ANFO was prepared. The blend was detonated under unconfined conditions in 102 mm diameter pipe and a velocity of detonation of 2,400 m/s was recorded.

Example I

Comparison Example 7 was repeated with the difference that the fuel oil component was replaced with a mixture of 20% sorbitol tristearate and 80% diesel. A velocity of detonation of 2,800 m/s was observed, indicating that the additive does not affect the velocity of detonation.

Example J

In this example, a blend of 40:60 parts emulsion:ANFO was prepared. The ammonium nitrate prill type for the ANFO was Rivno HDAN. The fuel oil component was replaced with a mixture of 20% sorbitol tristearate and 80% diesel. The blend was detonated under unconfined conditions in 200 mm diameter pipe. A velocity of detonation of 3,200 m/s was obtained.

In this specification, unless the context clearly indicates otherwise, the term "comprising" has the non-exclusive meaning of the word, in the sense of "including at least" rather than the exclusive meaning in the sense of "consisting only of". The same applies with corresponding grammatical changes to other forms of the word such as "comprise", "comprises" and so on. It will be apparent that obvious variations or modifications may be made which are in accordance with the spirit of the invention and which are intended to be part of the invention, and any such obvious variations or modifications are therefore within the scope of the invention.

INDUSTRIAL APPLICABILITY

The invention can be utilised in the mining or construction industries for blasting operations.

The invention claimed is:

1. A blended explosive composition comprising an emulsion explosive stabilized with an emulsifier and having dispersed therein a coated solid particulate oxidizer component, wherein the solid particulate oxidizer component comprises ammonium nitrate prill, and wherein the coating on the solid particulate oxidizer component comprises: a fuel component containing carbonaceous material selected from fuel oil, heating oil, diesel fuel, jet fuel, kerosene, mineral oils, and vegetable oil, and a binding agent comprising from 5% to 50% by weight of the fuel component dissolved in the carbonaceous material prior to coating the solid particulate oxidizer component, wherein the binding agent is selected from C36 to C100 long chain carboxylic acids comprising stearic acid or oleic acid having at least two carboxylic acid groups and its salts and derivatives thereof, and the binding agent being configured to bind the carbonaceous material of the fuel component to the solid particulate oxidizer component, thereby increasing the water resistance of the blended explosive composition.

2. The blended explosive composition of claim 1, wherein the carbonaceous material of the fuel component coating the ammonium nitrate grill is fuel oil and the binding agent is dissolved in the fuel oil, resulting in ammonium nitrate fuel oil (ANFO) with improved water resistance dispersed in the emulsion.

3. The blended explosive composition of claim 1, wherein the emulsion is an ammonium nitrate based emulsion (ANE).

4. The blended explosive composition of claim 1, wherein said C36 to C100 long chain carboxylic acid is selected from dimer acid C36, oleayl dimer monostearate, oleayl dimer distearate, sorbitan tristearate, diethylenetriamine tristearate, tetraglycerine tristearate, glycerol tristearate, tallow diamine distearate, tetrastearate, distearyl oleayl tetraglycerine.

5. The blended explosive composition of claim 1, wherein said C36 to C100 long chain carboxylic acid is the di- or tri-oligomers of stearic acid or oleic acid.

6. The blended explosive composition of claim 1, wherein said derivatives of the C36 to C100 long chain carboxylic acids are selected from any one or more of the esters, lactones, amides, lactams, anhydrides, acid chlorides or other halides, or imides of said acids.

7. The blended explosive composition of claim 1, wherein the binding agent comprises from 10% to 20% by weight of the fuel component.

8. The blended explosive composition of claim 7, wherein the fuel component carbonaceous material contains a substantial portion of diesel oil, and the remainder being mineral oil.

9. The blended explosive composition of claim 1, wherein the solid particulate oxidizer component contains a substantial portion of high density ammonium nitrate prill and/or low density non-porous prill, and the remainder being low density porous ammonium nitrate prill.

10. A method of increasing the water resistance, and/or increasing the sleep time, of a blended explosive composition comprising a blend of an emulsion explosive having a solid particulate oxidizer component comprising ammonium nitrate prill dispersed therein, which method comprises the steps of:

providing a fuel component containing carbonaceous material and a binding agent dissolved therein, wherein the carbonaceous material is selected from fuel oil, heating oil, diesel fuel, jet fuel, kerosene, mineral oils, and vegetable oil;

coating the solid particulate oxidizer component with the fuel component with the binding agent dissolved therein, wherein the particulate oxidizer component contains one or more oxidizer salts; and adding the coated particulate oxidizer to the emulsion to form the explosive, wherein the binding agent binds the carbonaceous material of the fuel component to the particulate oxidizer component, thereby increasing the water resistance of the blended explosive composition;

wherein the binding agent is selected from C36 to C100 long chain carboxylic acids comprising stearic acid or oleic acid having at least two carboxylic acid groups and its salts and derivatives thereof to a blended explosive composition characterized in that the binding agent is selected from one or more of dimer acid, trimer acid, oleic acid, stearic acid, sorbitan tristearate, and their salts and esters thereof.

11. The method of claim 10, wherein the binding agent being added comprises from 5% to 50% by weight of the fuel component.

12. The method of claim 11, wherein the binding agent being added comprises from 10% to 20% by weight of the fuel component.

13. The blended explosive composition of claim 1, wherein the emulsifier comprises at least one derivative of poly(isobutylene) succinic anhydride and an amine or alkanolamine emulsifier.

14. An explosive composition comprising an explosive emulsion stabilized with an emulsifier and having therein a solid particulate oxidizer component coated with a fuel component, wherein the solid particulate oxidizer component contains one or more oxidizer salts, and the fuel component contains carbonaceous material and a binding agent dissolved therein, wherein the carbonaceous material is selected from fuel oil, heating oil, diesel fuel, jet fuel, kerosene, mineral oils, and vegetable oil, and wherein the binding agent is selected from one or more of a long chain carboxylic acids and its salts and derivatives thereof, and the binding agent being configured to bind the carbonaceous material of the fuel component to the particulate oxidizer component, thereby increasing the water resistance of the explosive composition.

15. The explosive composition of claim 14, wherein the binding agent is selected from C36 to C100 long chain carboxylic acids comprising stearic acid or oleic acid having at least two carboxylic acid groups and its salts and derivatives thereof.

16. The explosive composition of claim 14, wherein the emulsifier comprises at least one derivative of poly(isobutylene) succinic anhydride and an amine or alkanolamine emulsifier.

17. A blended explosive composition comprising an emulsion explosive having dispersed therein a solid particulate oxidizer component, wherein the solid particulate oxidizer component comprises non-porous ammonium nitrate prill; and a fuel component coating the non-porous solid particulate oxidizer component, the fuel component containing carbonaceous material selected from fuel oil, heating oil, diesel fuel, jet fuel, kerosene, mineral oils, and vegetable oil, and a binding agent dissolved in the carbonaceous material prior to coating the non-porous solid particulate oxidizer component, wherein the binding agent is selected from C36 to C100 long chain carboxylic acids comprising stearic acid or oleic acid having at least two carboxylic acid groups and its salts and derivatives thereof, and the binding agent configured to bind the carbonaceous material of the fuel component to the non-porous particulate oxidizer component, thereby stabilizing the blended explosive composition.

* * * * *